US005241336A

United States Patent [19]

Glover et al.

[11] Patent Number: 5,241,336

[45] Date of Patent: Aug. 31, 1993

[54] PROCESSING UNIT

[75] Inventors: Edward Charles T. S. Glover, London; Paul C. Ward, Watford; Leslie J. H. Pummell, Rickmansworth; Geoffrey D. Marshall, Watford, all of United Kingdom

[73] Assignee: Eastman Kodak Company, Rochester, N.Y.

[21] Appl. No.: 721,561

[22] PCT Filed: Feb. 1, 1990

[86] PCT No.: PCT/GB90/00161

§ 371 Date: Aug. 19, 1991

§ 102(e) Date: Aug. 19, 1991

[87] PCT Pub. No.: WO90/08981

PCT Pub. Date: Aug. 9, 1990

[30] Foreign Application Priority Data

Feb. 1, 1989 [GB] United Kingdom ..... 8902185
Feb. 1, 1989 [GB] United Kingdom ..... 8902187

[51] Int. Cl.[5] ..... G03D 3/08

[52] U.S. Cl. ..... 354/320; 354/322

[58] Field of Search ..... 354/317-324, 354/338, 339; 134/64 R, 64 P, 122 R, 122 P

[56] References Cited

U.S. PATENT DOCUMENTS 3,421,675 1/1969 Brown et al. ..... 354/339
3,698,306 10/1972 Fairbanks ..... 354/339 X
3,769,897 11/1973 Zwettler et al. ..... 354/321
3,785,269 1/1974 Morioka ..... 354/322
4,156,569 5/1979 Fasano ..... 354/322
4,185,912 1/1980 Schwartz ..... 354/322 X
4,362,376 12/1982 Otani ..... 354/319

FOREIGN PATENT DOCUMENTS 2048461 10/1970 Fed. Rep. of Germany ..... 354/338
2414824 10/1974 Fed. Rep. of Germany ..... 354/322
2190899A 12/1987 United Kingdom .

*Primary Examiner*—D. Rutledge
*Attorney, Agent, or Firm*—Clyde E. Bailey

[57] ABSTRACT

The critical time in photographic processing apparatus is the time from when the first part of photographic material enters the apparatus to when the last part leaves the apparatus. During this time there are periods of time in which no processing takes place, for example, as the material is passed from one stage to the next. Described herein is a processing unit which minimizes the periods of time during which no processing is taking place. The unit comprises a processing tank (6) having processing solution (4) retained therein. Material (S) is fed into the tank (6) along a path (2), and around a looped path (8) until reaches a point (10) at which the material (S) can be deflected out of the tank (6), along path (14) and into a further processing tank (16), or can be deflected along path (12) so that further processing can take place in tank (6) prior to being passed on to the next stage.

14 Claims, 8 Drawing Sheets

PROCESSING UNIT

TECHNICAL FIELD

The present invention relates to a processing unit and more particularly, but not exclusively, to a processing unit for treating photographic materials.

BACKGROUND OF THE INVENTION

In the field of photographic processing, a photographic material, for example a film, is passed through one or more processing stages. Examples of such stages are development, bleach, bleach-fix, wash, fix and drying. The time spent in each of these stages depends on a number of factors, such as the type of material being processed and the temperature at which processing takes place.

In most existing photographic processing units, the photographic material passes relatively slowly through each stage so that it can spend as long as is desired in that stage, without the necessity of utilizing relatively large apparatus for each stage. This is the situation particularly in the case of minilab processors where it is important to restrict the total physical size of the apparatus as much as possible. This, however, has the disadvantage that the photographic material passes relatively slowly from one stage to the next, thus increasing the lengths of time during which no actual processing takes place.

Furthermore, the critical time in such apparatus is the time from when the first part of a photographic material enters the processor to when the last part of the material leaves the processor. This is known as the "access time". This can be seen to be the same as the sum of the "process time" (the period between the first part of a photographic material entering the processor and that part reaching the exit of the processor) and the time required to discharge the entire material from the processor. The "access time" is clearly increased by a relatively low linear speed.

To reduce the periods of time during which no actual processing takes place, and to reduce the "access time", it is therefore desirable to increase the linear speed at which the photographic material passes from one stage to the next and the rate at which it passes out of the processor.

However, if the path length traveled by the material in a stage is fixed, an increase in linear speed will reduce the period of time that the material spends in that stage. Similarly, altering the time spent by the material in one stage by altering the linear speed in that stage has the effect of altering the linear speed in any subsequent stages.

It is therefore desirable to utilize a system where the time spent in each stage and the linear speed out of the stages can be independently set.

By the very nature of the minilab, film fed in for processing is normally in the form of individual strips, rather than in the form of a continuous web formed of a large number of spliced strips, as is normally the case with large processing units. This necessitates the use of some form of device for feeding the strips into and through the apparatus.

U.S. Pat. No. 3,698,306 describes an arrangement in which photographic material is fed through guide means into a processing station and in which the photographic material is moved at a relatively high speed through the station. After the photographic material has left the station it is deflected by a deflector either back to the entrance of that station or on to the entrance of the next and passes through the atmosphere, even if it is being deflected back to the entrance of that station for a further cycle through that station. This has the disadvantage that no actual processing takes place during a period which is in effect a part of the processing cycle, as well as during the period when the photographic material is passing between stations. Furthermore, periods spent in the atmosphere can have adverse effects. For example developer will become increasingly oxidized.

According to one aspect of the present invention, there is provided apparatus for treating photographic material comprising:

at least one treatment station containing processing solution, feed means for feeding the material into the treatment station, cycling means for cycling the material around within the treatment station for a desired number of times, the material remaining submerged in the processing solution as it is cycled around within the treatment station, guiding means for guiding the movement of the material within the station, and deflecting means within the station for selectively deflecting the material so that it either remains within the station for a further cycle or exits from the station, characterized in that the deflection of the material is caused by a change in the guiding means actuated by the deflecting means.

By this arrangement, the periods of time during which no actual processing takes place is substantially reduced. Furthermore, the periods of time spent in the atmosphere are also reduced.

Advantageously, the deflecting means comprises a member which is movable so as to align an inlet guide with a selected one of at least two outlet guides. The member may be provided with one or more further guides therein, the member being movable so as to selectively align one of the further guides with the inlet guide and with one of the outlet guides in order that the material passes along a desired path.

The member may be slidable, rotatable, or pivotable about a fixed point to provide the desired alignment.

BRIEF DESCRIPTION OF THE DRAWINGS

For a better understanding of the present invention, reference will now be made, by way of example only, to the accompanying drawings in which.

DETAILED DESCRIPTION OF THE INVENTION

The following description will be directed to apparatus for processing a photographic film strip but it is emphasized that it could equally be used for handling any type of web or sheet material, photographic or otherwise.

Figure 1:
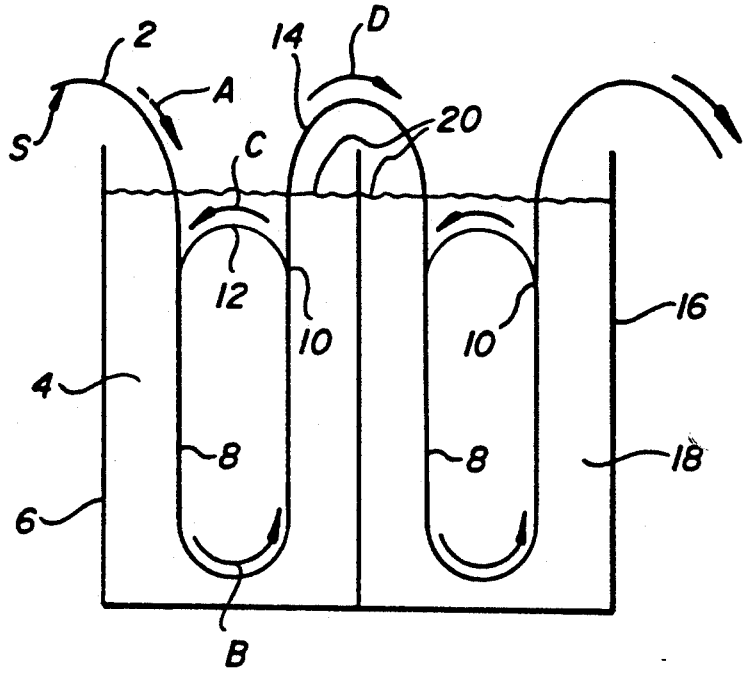
FIG. 1 is a schematic view of a possible path taken by a film through processing apparatus.

In the arrangement shown in FIG. 1, a film strip passes along a path 2, in the direction indicated by arrow A, into processing solution 4 retained in a processing tank 6. The film strip then passes along a looped path 8, as indicated by arrow B, until it reaches point 10 at which it can take one of two directions, namely, that indicated by arrow C along a path 12 so as to remain within the solution 4 for further processing, or that indicated by arrow D along a path 14 out of the solution 4 and on to a further processing tank 16 containing a second processing solution 18. It can be seen that the path 8 and hence the point 10 are below surface 20 of the solution 4.

A squeegee arrangement (not shown) could be provided, if desired, in path 14. This could take the form, for example, of a roller or a scraper.

Whether a film strip will take path 12 or path 14 will depend on processing requirements, for example, it may be desired to continue processing in tank 6 for a further period of time.

The drive arrangement in tank 16 is the same as in tank 6 and so need not be described.

In FIG. 1, two tanks 6, 16 are shown. It is however emphasized that any number of tanks in series can be used. They may all contain different processing solutions or one tank could in fact contain the same processing solution as another tank. Furthermore, a tank could in fact contain no processing solution at all, for example it could be some form of drying stage.

Although in FIG. 1 the film strip is shown as passing from the tank 6 to the adjacent tank 16, it could in fact, by an arrangement not shown, pass on to a further tank (not shown) beyond tank 16. In other words, the film strip could skip a tank. This enables the apparatus to be very adaptable in that the stages through which a film strip passes can be selected as desired. The combination of this facility with that of being able to select the time for which the film strip cycles around a particular stage renders the apparatus extremely flexible for processing a variety of film strips under a variety of required conditions.

Figure 2:
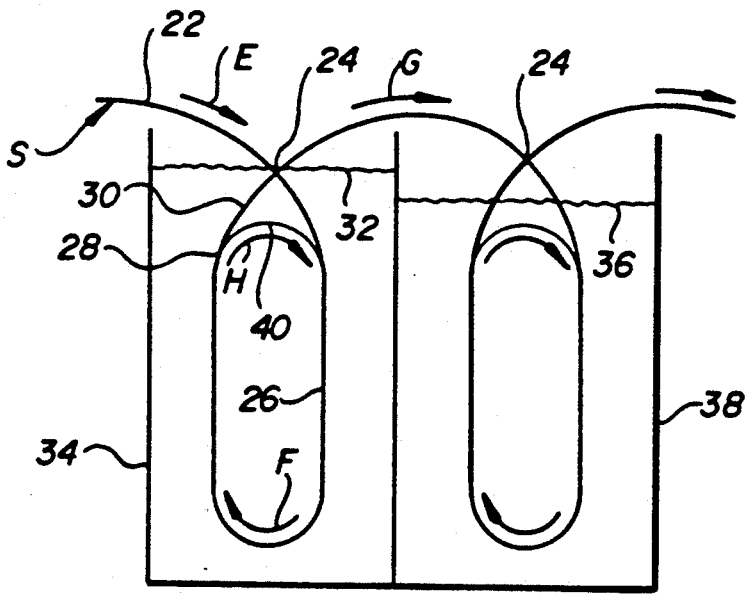
FIG. 2 is a schematic view of an alternative path taken by a film through processing apparatus.

FIG. 2 shows an arrangement where the film strip passes along a path 22, in the direction indicated by arrow E, to a crossover point 24 and then to a looped path 26, in the direction of arrow F. The film strip then passes to a point 28 at which it can take one of two directions in a similar to that in the arrangement shown in FIG. 1. If the film strip takes the direction that leads along a path 30, as indicated by arrow G, it will pass through the crossover point 24. As shown in FIG. 2, while the path 26 is completely below surface 32 of the solution, as is also point 28, the crossover point can be either below surface 32 as shown in tank 34 or above surface 36 as shown in tank 38. Alternatively, the film strip can take the direction along path 40, as shown by arrow H, to remain within the tank.

Figure 4:
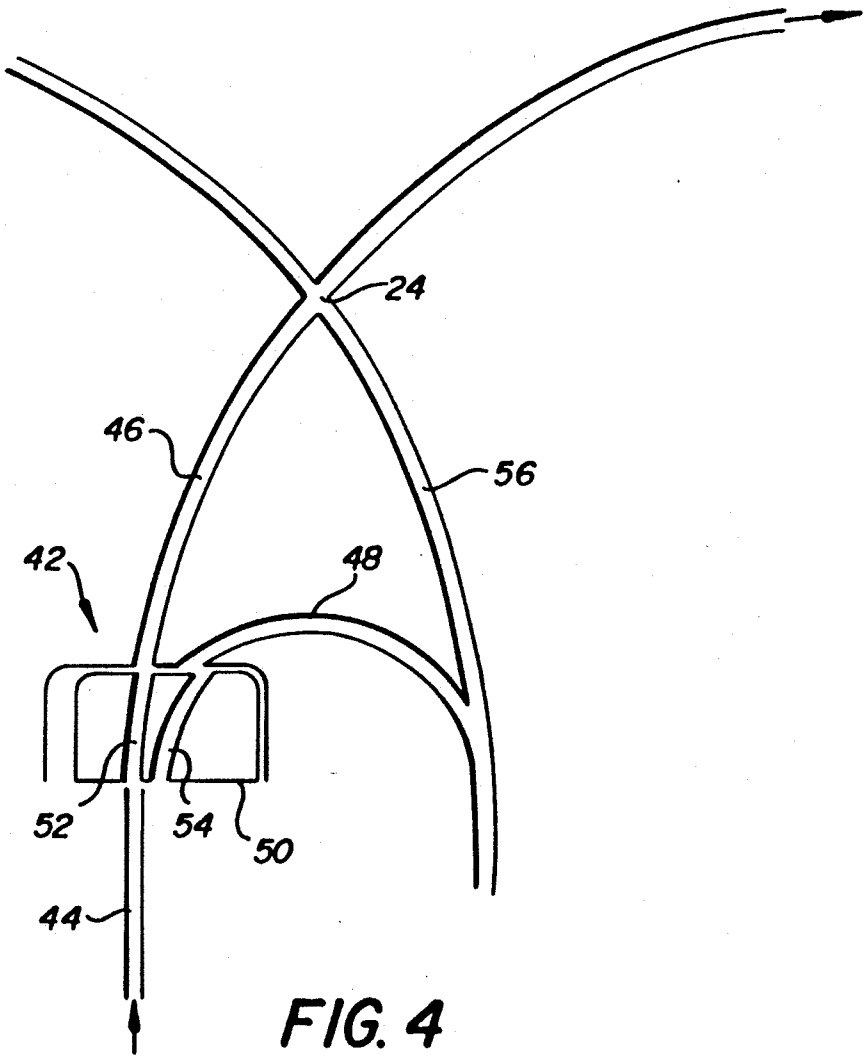
FIG. 4 shows the switch of FIG. 3 in a second position.
Figure 3:
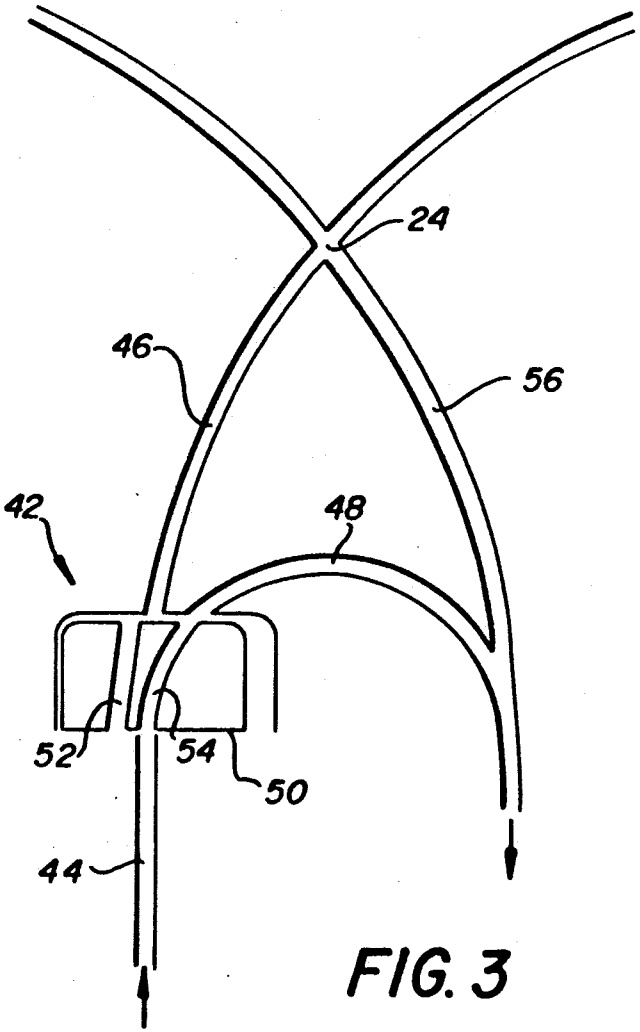
FIG. 3 shows a switch which can be used for controlling the direction of film movement through the apparatus of FIGS. 1 and 2 in a first position.

FIGS. 3 and 4 show a switch 42 for use at point 28 in FIG. 2. The description of the switch 42 will be in relation to the arrangement shown in FIG. 2 but it is equally applicable to point 10 in FIG. 1. A guide 44 is provided in path 26 for guiding a film strip into the switch 42, i.e. along paths indicated by arrows G and H respectively in FIG. 2. Guides 46 and 48 are provided for selectively guiding the film strip away from the switch 42. A slidable member 50 which contains further guides 52 and 54 is positioned between the guide 44 on the one hand and guides 46 and 48 on the other hand.

The operation of the switch 42 is as follows: if it is desired that the film strip received along guide 44 is to pass into guide 48, that is, along path 40, the member 50 is slid into the position shown in FIG. 3, so that guides 44, 54 and 48 are in alignment. If on the other hand, it is desired that the film strip is to pass into guide 46, that is, along path 30, the member 50 is slid into the position shown in FIG. 4, so that guides 44, 52 and 46 are in alignment.

Also shown in FIGS. 3 and 4 is crossover 24 which comprises guides 46 and 56.

Figure 5:
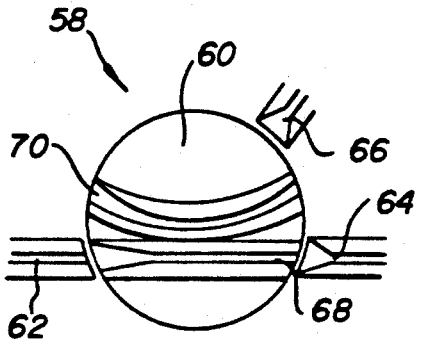
FIG. 5 shows an alternative form of switch which can be used in the apparatus of FIGS. 1 and 2 in a first position.
Figure 6:
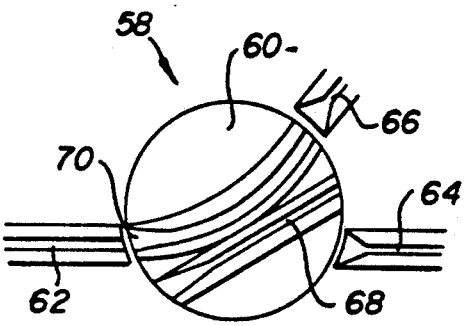
FIG. 6 shows the switch of FIG. 5 in a second position.

In FIGS. 5 and 6, there is shown a switch 58 which comprises a cylinder 60 rotatably mounted in any suitable manner. A guide 62 is provided in path 26 for guiding a film strip into the switch 58. Guides 64 and 66 are provided for selectively guiding the film strip away from the switch 58 as described previously. The cylinder 60 contains further guides 68 and 70 and is positioned between the guide 62 on the one hand and guides 64 and 66 on the other hand.

The operation of the switch 58 is as follows: if it is desired that the film strip received along guide 62 is to pass into guide 64, the cylinder 60 is rotated into the position shown in FIG. 5, so that guides 62, 68 and 64 are in alignment. If on the other hand, it is desired that the film strip is to pass into guide 66, the cylinder 60 is rotated into the position shown in FIG. 6, so that guides 62, 70 and 66 are in alignment.

Figure 7:
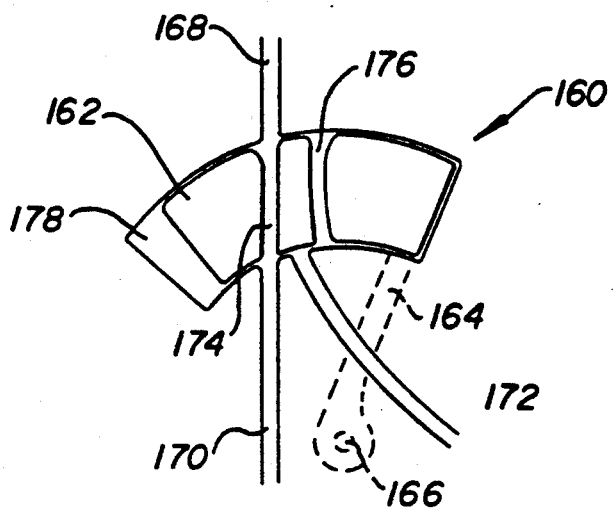
FIG. 7 shows a further alternative form of a switch which can be used in the apparatus of FIGS. 1 and 2 in a first position.
Figure 8:
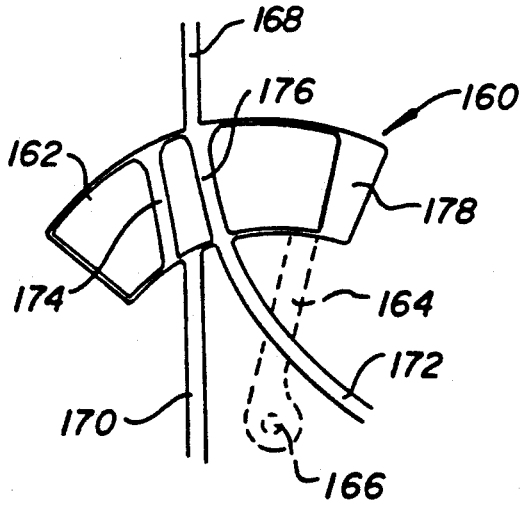
FIG. 8 shows the switch of FIG. 7 in a second position.

FIGS. 7 and 8 illustrate a further embodiment of a switch 160 which can be used to deflect the strip of material S in the processing apparatus. The switch 160 comprises an arcuate member 162 which is housed in an arcuate slot 178. The member 162 is connected for pivotal movement about a fixed pivot 166 by means of an arm 164. Two guides 174, 176 are formed in the member 162 which provide connection between respective guides 168 and 170 (as shown in FIG. 7), and guides 168 and 172 (as shown in FIG. 8).

The member 162 can be actuated by a solenoid or be motor driven (not shown).

Figure 9:
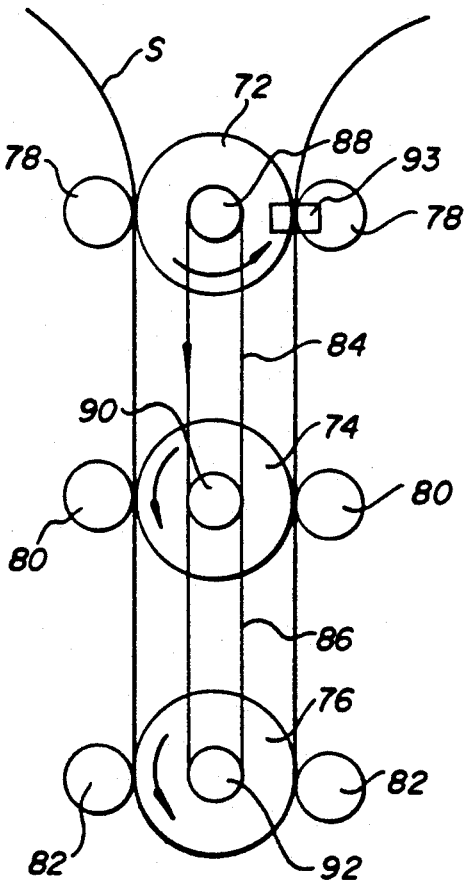
FIG. 9 shows an arrangement for driving a film through the apparatus.

In the arrangement shown in FIG. 9, drive rollers 72, 74 and 76 are positioned inside the path 8 (see FIG. 1) so as to bear on the inside surface of a film strip S. Associated with drive roller 72 are a pair of geared or driven, such as surface driven, rollers 78, which may be smaller, larger or the same size as the drive roller 72. Rollers 78 bear on the opposite surface of film strip S to that of drive roller 72. Similarly, geared or driven rollers 80 and 82 are associated with drive rollers 74 and 76, respectively.

The drive rollers 72, 74 and 76 are driven synchronously by chains 84 and 86 which engage gear wheels 88, 90 and 92 mounted on drive rollers 72, 74 and 76, respectively.

A switch 93 is positioned adjacent drive roller 72 for determining whether the film strip S is sent back around the path through the rollers 72, 78, 74, 80, 76, 82, or whether it is passed to the next stage of the processor.

Figure 10:
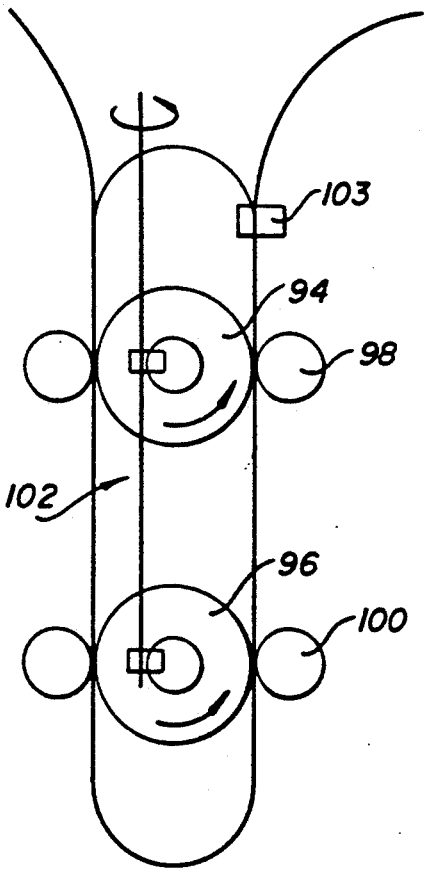
FIG. 10 shows an alternative arrangement for driving a film through the apparatus.

In the arrangement shown in FIG. 10, drive rollers 94 and 96 are provided, together with associated geared or driven, such as surface driven, rollers 98 and 100, respectively. Drive rollers 94 and 96 are driven by a worm and wheel arrangement 102, although a chain arrangement as shown in FIG. 9 can alternatively be used. In the arrangement shown in FIG. 10, switch 103 is spaced from the drive roller 94.

The drive rollers for one tank could either be driven independently from one another or coupled together. Also the drive rollers for one tank could either be driven independently from the drive rollers for another tank or they could have a common drive.

Alternatively, a roller transport drive could be used with the film strip being driven by closely-spaced rollers positioned alternately on each side of the film strip.

Each guide track would normally be coupled to its neighbor(s) so that the tracks feed from one to the next without allowing the film strip to meet any resistance. This would normally be achieved by funnelling the inlet to the downstream track.

The arrangements shown in FIGS. 9 and 10 show that having drive rollers at the upper and lower ends of the cyclic path is optional. In both arrangements, the film strip S is guided by a guide, various forms of which are described below.

Figure 11:
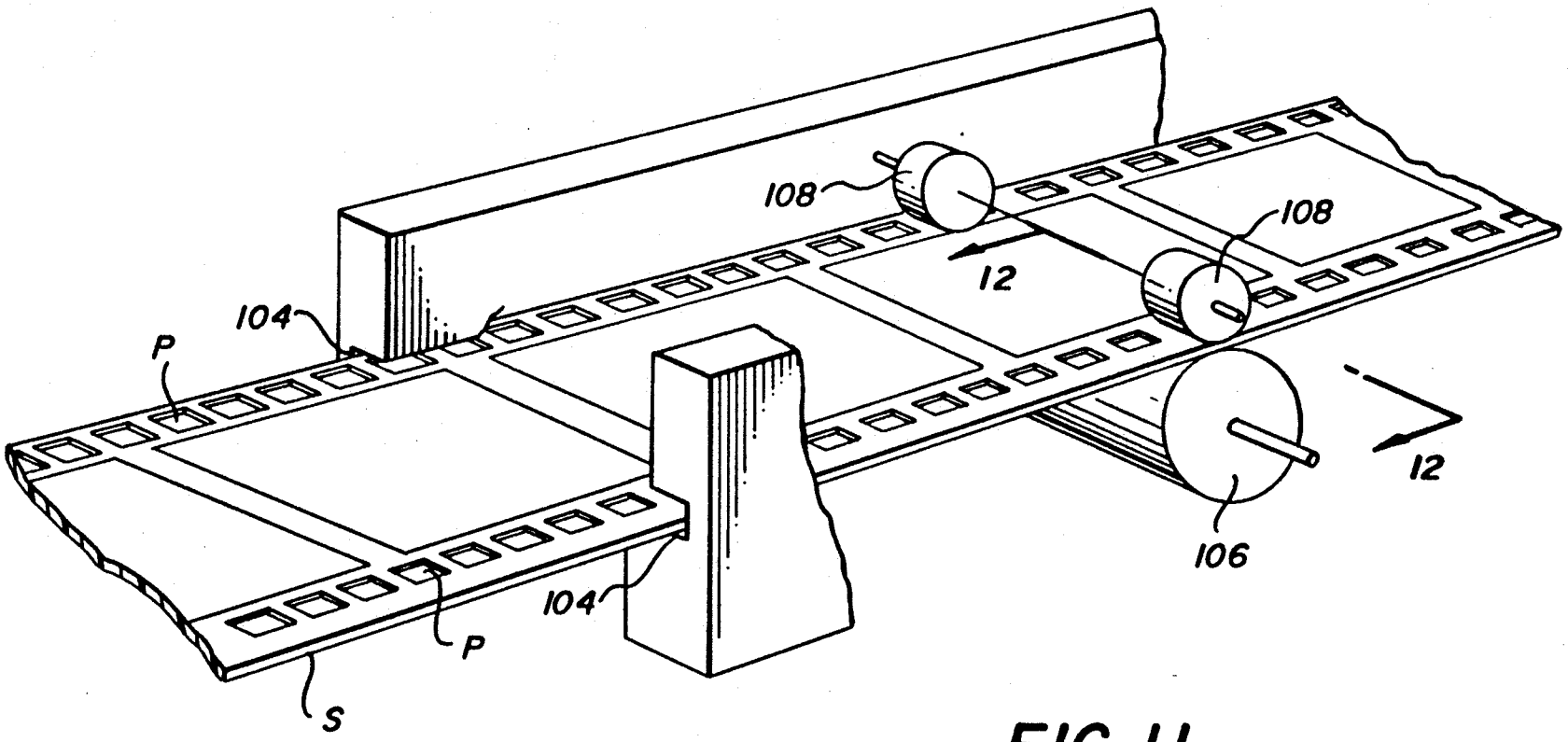
FIG. 11 shows in more detail a portion of the arrangements shown in FIGS. 9 and 10.

In the arrangement shown in FIG. 11, film strip S having perforations P along its longitudinal edges is passed with those edges within guide grooves 104 forming part of a guide track mounted within the processing tank. The guide grooves 104 can be machined or moulded in plastics material or metal sheet or as a well supported framework. A drive roller 106 bears on the rear surface of the film strip S and geared or driven rollers 108 bear on the front surface of the film strip S along the position of the perforations P, in the manner shown in FIGS. 9 and 10.

Figure 12:
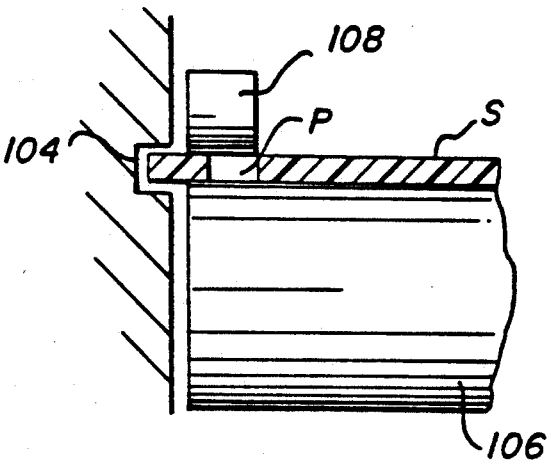
FIG. 12 is a section taken along the line XII—XII in FIG. 11.

FIG. 12 shows more clearly the relationship between the film strip S and one groove 104. The groove 104 has been shown as having a U-shaped cross-section but any suitable cross-section can be utilized such as, for example, V-shaped.

The dimensions of the guide track are chosen to be large enough to guide the film strip but small enough to eliminate the possibility of scratches on the picture area. The length of the guide track in a tank is chosen to be longer than the longest film for which the processor is designed and the location and number of driver points is chosen to suit the shortest length of film, although the processor can have any number of drive points.

Although in FIG. 11 the film strip S is shown having perforations along both of its longitudinal edges, it could in fact be of the form having perforations along only one longitudinal edge or of the form having no perforations at all.

Figure 13:
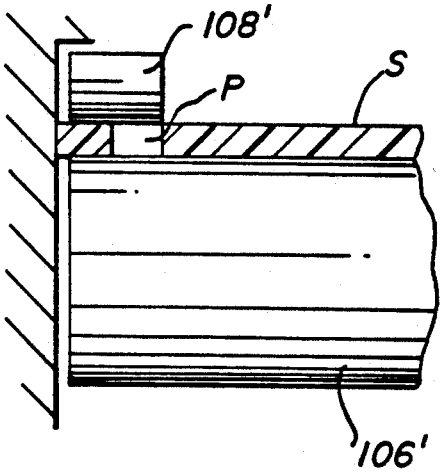
FIG. 13 is a section similar to that shown in FIG. 12 but of a second embodiment of the film drive arrangement.

FIG. 13 shows an alternative embodiment similar to that shown in FIG. 12 but which does not utilize grooves. Parts similar to those in FIG. 12 are indicated by the same numerals but with a prime.

Figure 14:
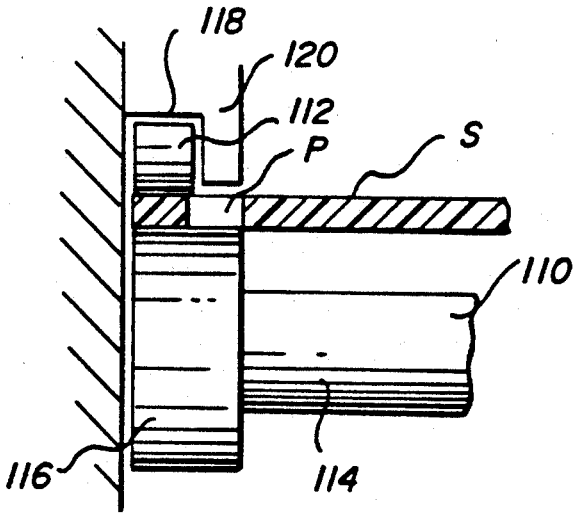
FIG. 14 is a section similar to that shown in FIG. 12 but of a third embodiment of the film drive arrangement.

In the arrangement shown in FIG. 14, the longitudinal edge of film strip S passes between a drive roller 110 and a geared or driven roller 112. The drive roller 110 has a smaller diameter in its central portion 114 than in end portion 116 which bears against the film strip S. The roller 112 is positioned within a recess 118 formed by a guide fence 120.

Figure 15:
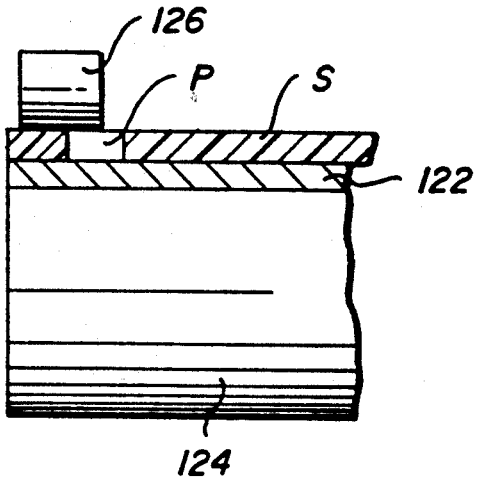
FIG. 15 is a section similar to that shown in FIG. 12 but of a fourth embodiment of the film drive arrangement.

The arrangement shown in FIG. 15 utilized a flat continuous flexible belt 122 which passes over a drive roller 124. The film strip S is positioned between the belt 122 and a geared or driven roller 126.

Figure 16:
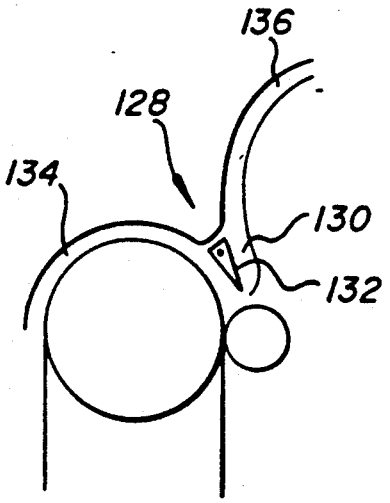
FIG. 16 shows a further form of switch for controlling the direction of film movement, particularly for use in the drive arrangement shown in FIG. 15 in a first position.
Figure 17:
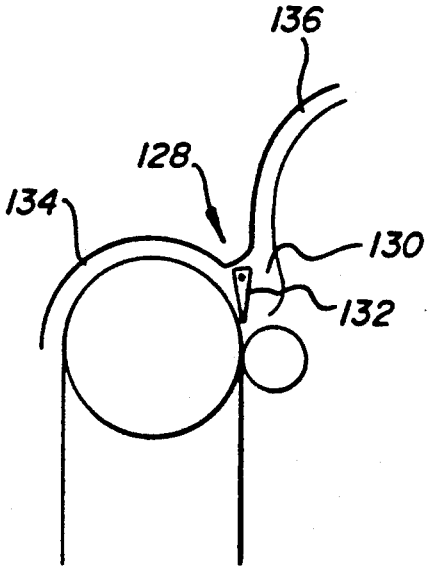
FIG. 17 shows the switch of FIG. 16 in a second position.

Referring to FIGS. 16 and 17, a switch 128 is provided for selecting the direction that will be taken by the film strip S at point 130. The switch 128 is provided within a pivotal plate 132 which when in the position shown in FIG. 16 directs the film strip S along the path 134. When the plate 132 is in the position shown in FIG. 17, it directs the film strip S along the path 136.

Figure 18:
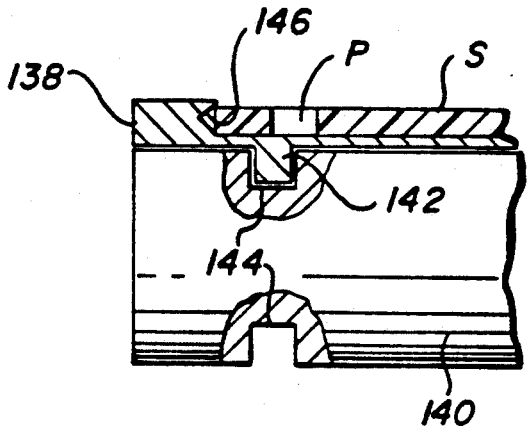
FIG. 18 is a section similar to that shown in FIG. 12 but of a fifth embodiment of the film drive arrangement.

FIG. 18 shows an alternative form of continuous flexible belt 138 which passes over a drive roller 140 and has a projecting rib 142 which engages a circumferential groove 144 in the roller 140. The film strip S is positioned on the belt 138, the longitudinal edge of the film strip S being gripped by a longitudinal groove 146 provided on the longitudinal edge of the belt 138. The groove 146 is shown as being of V-shaped cross-section but any other suitable cross-section can be utilized.

Figure 19:
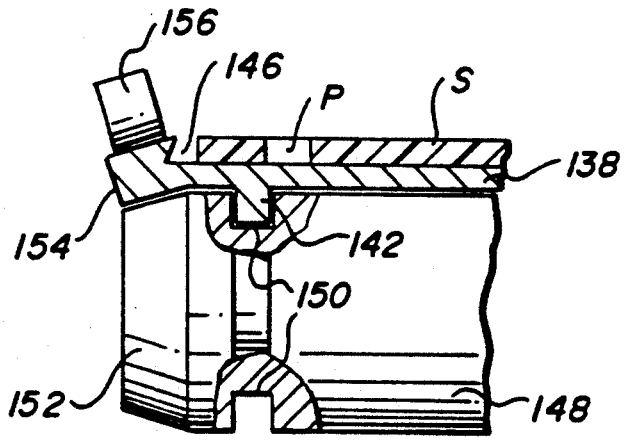
FIG. 19 is a section through an exit arrangement used in conjunction with the drive arrangement shown in FIG. 18.

In FIG. 19 is shown a roller 148 used at an "exit" point of an arrangement using the apparatus shown in FIG. 18. The projecting rib 142 of the belt 138 engages a circumferential groove 150 in the roller 148. The roller 148 has a tapering end section 152 and as the belt 138 passes over it, its resilience allows a section 154 thereof to be so urged by a roller 156 that it stays in contact with the section 152. This causes the groove 146 to open out as shown, so allowing the film strip S to pass tangentially out of contact with the belt 138.

The use of continuous flexible belts allow wider and thus less rigid film strips to be processed and for all the film strips would allow the use of jets under the liquid surface to improve agitation by disrupting the boundary layers.

Although in the above description the film strip has been shown being driven by friction arrangements, that is rollers and belts, it can also be driven by means which engage the perforations P.

To make full use of the features of this processor, it would normally be software controlled. Input signals to a computer might include solution temperature(s), solution level(s), filter condition(s), motor speed(s), switch positions, film start/finish positions, film load and unload sequences. Internal counters might also log the number of films processed through a given batch of solution and when the solution was last changed.

As described above, the processor of the present invention is so arranged that while a film strip is being processed within a particular solution it remains beneath the surface of that solution for the complete period that it is in the tank. In other words, it does not leave the solution until it is required that it pass on to the next tank or out of the processor. This ensures that the period for which the film strip is not being processed and is being subjected to possible aerial oxidation is reduced to a minimum.

Furthermore, because the film strip remains beneath the surface of the processing solution, the processing time does not depend on the level of the solution.

Higher speeds also have the advantage of providing higher agitation within the processing solution. All of the reactions carried out in a photographic process are diffusion controlled and therefore the thickness of the boundary layer is of crucial importance to the rate of the process. Increasing linear speed of the film strip increases reaction rates by reducing the boundary layer thickness.

Furthermore, by cycling the film strip in each tank, it is in effect subjected to an average of the solution, so that if there were temperature or concentration gradients, these would be of minor significance. The mere fact of cycling the film will help to mix the tank contents.

Because the processing time can be altered by altering the number of cycles in a tank, all of the tanks can be made identical, which considerably simplifies manufacture and servicing.

Which it is advantageous for the photographic material being processed to spend as little time as possible in the atmosphere, there are also reasons why it may be desirable to restrict the speed at which the material passes from one tank to the next, such as for example to reduce the carry-over of solution. The apparatus would be operated at an optimum setting, which could still be faster than that encountered in existing arrangements. Such a setting could involve speeds within the tanks which are different from those at which the material passes between tanks.

Although all the embodiments of the switch described above have one inlet path and two outlet paths, it is emphasized that one could alternatively have more than one inlet path and more than two outlet paths. This would clearly necessitate an increase in the number of guides in the switch.

Furthermore, it is pointed out that the switch could be arranged such that there is for example only one outlet path but more than one inlet path.

We claim:

1. Apparatus for treating photographic material (S) comprising:

at least one treatment station (6; 34) containing processing solution (4; 32), feed means for feeding the material (S) into the treatment station (6; 34), cycling means (72, 74, 76, 78, 80, 82; 94, 96, 98, 100) for cycling the material (S) around within the treatment station (6; 34), the material (S) remaining submerged in the processing solution (4; 32) as it is cycled around within the treatment station (6; 34), guiding means (8, 12; 26, 40, 44, 48; 62, 66; 168, 172; 104; 120; 134; 146) for guiding the movement of the material (S) within the station (6; 34), and deflecting means (10; 28; 42; 58; 160; 93; 103; 128; 152, 156) within the station (6; 34) for selectively deflecting the material (S) so that it either remains within the station (6; 34) for a further cycle or exits from the station (6; 34), characterized in that the deflection of the material (S) is caused by a change in the guiding means (8, 12; 26, 40, 44, 48; 62, 66; 168, 172; 104; 120; 134; 146) actuated by the deflecting means (10; 28; 42; 58; 160; 93; 103; 128; 152, 156).

2. Apparatus according to claim 1, wherein the deflecting means (42; 58; 160; 128) comprises a member (50; 60; 162; 132) which is movable so as to align an inlet guide (44; 62; 168) with a selected one of at least two outlet guides (46, 48; 64, 66; 170, 172; 134, 136).

3. Apparatus according to claim 2, wherein the member (50; 60; 162) is provided with one or more further guides (52, 54; 68, 70; 174, 176) therein, the member (50; 60; 162) being movable so as to selectively align one of the further guides (52, 54; 68, 70; 174, 176) with the inlet guide (44; 62; 168) and with the selected one of the outlet guides (46, 48; 64, 66; 170, 172; 134, 136) in order that the material (S) passes along a desired path.

4. Apparatus according to claim 2, wherein the member (50) is slidable to provide the desired alignment.

5. Apparatus according to claim 2, wherein the member (60) is rotatable to provide the desired alignment.

6. Apparatus according to claim 2, wherein the member (162) is pivotable about a fixed point (166) to provide the desired alignment.

7. Apparatus according to claim 2, wherein the inlet guides (44; 62; 168) and outlet guides (46, 48; 64, 66; 170, 172; 134, 136) comprise channels through which at least a part of the material (S) passes.

8. Apparatus according to claim 1, wherein the cycling means comprises one or more rollers (72, 74, 76, 78, 80, 82; 94, 96, 98, 100) for frictionally engaging the surface of the material (S).

9. Apparatus according to claim 1, wherein the cycling means includes a continuous flexible drive belt (122; 138).

10. Apparatus according to claim 9, wherein the drive belt (138) is carried by a drive roller (140; 148) and is provided with a rib (142) which engages a groove (144; 150) formed in the roller (140; 148).

11. Apparatus according to claim 10, wherein the guiding means comprises a longitudinal groove (146) along at least one edge of the drive belt (138) which groove is engageable with a longitudinal edge of the material (S).

12. Apparatus according to claim 1, wherein the guiding means comprises one or more grooves (104) mounted in the treatment station (6; 34) for receiving one or more longitudinal edges of the material (S).

13. Apparatus according to claim 1, comprising at least one further treatment station (16; 38): similarly constructed to the first-mentioned treatment station (6; 34).

14. Apparatus according to claim 13, further comprising means whereby the material (S) upon exiting from a treatment station (6; 34) may selectively pass to the next successive treatment station (16; 38) or to a treatment station beyond the next successive station.

* * * * *